United States Patent [19]

Sanderson

[11] 4,223,877

[45] Sep. 23, 1980

[54] ANNEALING FURNACE

[75] Inventor: Karl Sanderson, King City, Canada

[73] Assignee: Lee Wilson Engineering Company of Canada, Downsview, Canada

[21] Appl. No.: 974,316

[22] Filed: Dec. 29, 1978

[51] Int. Cl.[3] ..... C21D 9/00
[52] U.S. Cl. ..... 266/262
[58] Field of Search ..... 266/262, 263, 264; 148/13, 13.1

[56] References Cited

U.S. PATENT DOCUMENTS 3,370,993 2/1968 Carpenter et al. ..... 148/13.1

*Primary Examiner*—R. Dean

[57] ABSTRACT

A protective sleeve, for a cover used to enclose metal coils in an annealing furnace having a plurality of fuel burners whereby the coils are protected from the direct flame of the burners, comprising a circumscribing band mounted on the cover and held in spaced relationship from the cover, the band being interposed between the cover and the burners.

5 Claims, 3 Drawing Figures

FIG. 1
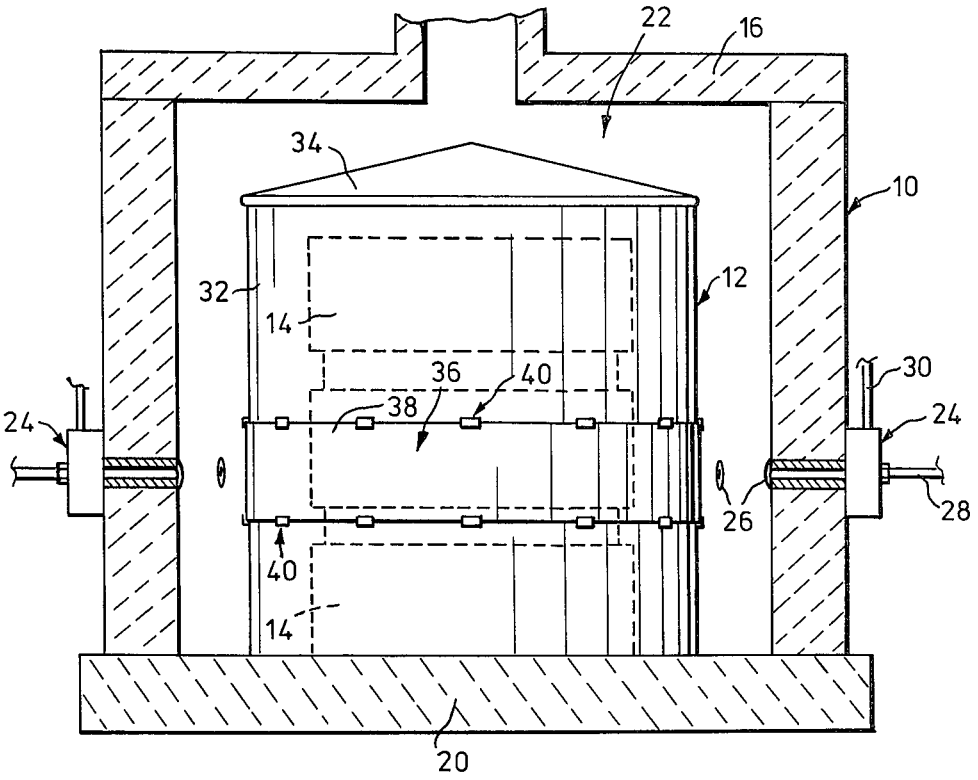
FIG. 2
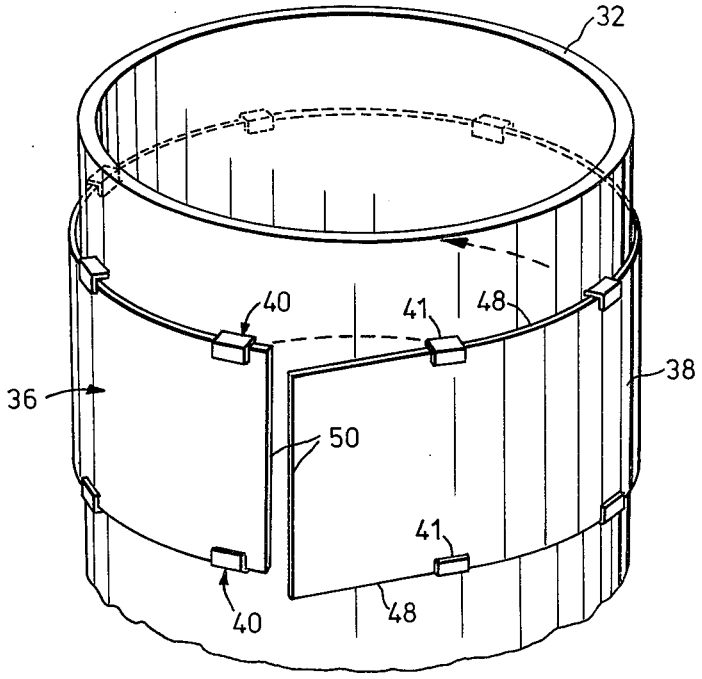
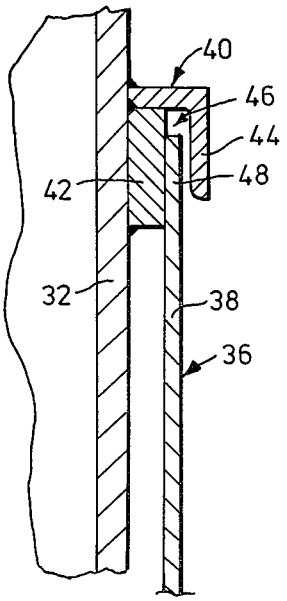
FIG. 3

ANNEALING FURNACE

FIELD OF THE INVENTION

This invention is related to an annealing furnace.

BACKGROUND OF THE INVENTION

In furnaces used to anneal metals in coils or other forms the coils are stacked in a refractory lined furnace having a plurality of burners directed into the furnace well. To protect the coils from coming into direct contact with the products of combustion an inner cover is placed over the coils. However, the high temperature developed in the cover by direct or close contact with the flame of the burners damages the cover which shortens its life.

It is an object of the present invention to provide a device which will prolong the life of an inner cover used in an annealing furnace.

SUMMARY OF THE INVENTION

Essentially the present invention consists of a protective sleeve, for a cover used to protect metal coils and the like in an annealing furnace having a plurality of fuel burners whereby the coils are protected from the direct flame of the burners, comprising a circumscribing band mounted on the cover and held in space relationship from the cover, the band being interposed between the cover and the burners.

BRIEF DESCRIPTION OF THE DRAWINGS

An example embodiment of the invention is shown in the accompanying drawings in which:

FIG. 1 is a cross-sectional elevational view of an annealing furnace having a cover therein carrying a protective sleeve;

FIG. 2 is a perspective view of the cover shown in FIG. 1 with the protective sleeve being mounted on the cover; and FIG. 3 is a partial cross-sectional view of the cover with the sleeve mounted thereon.

DETAILED DESCRIPTION

In the example embodiment shown in the drawings an annealing furnace 10 contains a cover 12 which encloses a stack 14 of coils to be heat treated as seen in FIG. 1 of the drawings. Furnace 10 has a removable lid 16 and a cylindrical wall 18 resting on a base 20 to enclose a heating chamber 22. Wall 18 carries a plurality of spaced fuel burners located in a ring around the furnace, each burner having a nozzle 26 projecting into chamber 22 and being fed by a fuel inlet line 28 and on air intake line 30.

Cover 12 comprises a cylindrical side wall 32 and a top 24. A protective sleeve 36 circumscribes side wall 32 facing nozzles 26 of burners 24. Sleeve 36 comprises a metal bank 38 which is held on the side wall by bracket means 40 arranged in a pair of spaced rings and fixed to the side wall. Each bracket means 40 consists of a plurality of laterally spaced brackets 41 having a base member 42 and an overhanging flange 44 forming, with the base member, a channel 46 which receives a lateral edge portion 48 of band 38 as seen in FIG. 3 of the drawings.

To install protective sleeve 36 it is merely necessary to thread band 38 through channels 46 of brackets 40 as seen in FIG. 2. Preferably the ends 59 of band 38 are butt welded. When mounted in this manner, band 38 is spaced from wall 32 of cover 12 by base members 42 of brackets 40 as seen in FIG. 3.

Sleeve 36, which is easily replacable and inexpensive relative to cover 12, protects the cover from the direct effects of burners 24 and prolongs its life. Also, sleeve 36 provides a more even distribution of temperature on cover 12. Sleeve 36 may be made of any suitable material such as stainless steel.

I claim:

1. A protective sleeve, for a cover used to enclose metal coils and the like in an annealing furnace having a plurality of fuel burners whereby the coils are protected from the direct flame of the burners, comprising a circumscribing band interposed between the cover and the burners, the band being mounted on the cover and held in spaced relationship therefrom by a spaced pair of bracket means fixed on the cover each in a ring arrangement, the band being threaded between the pair of bracket means and held thereby.

2. A sleeve as claimed in claim 1 in which the ring arrangement of each bracket means comprises a plurality of laterally spaced brackets each of said brackets forming a channel, the lateral edges of the band lying in the channels of the brackets.

3. A sleeve as claimed in claim 2 in which each bracket includes a base member fixed to the cover, the band being spaced from the cover by the base member.

4. A sleeve as claimed in claim 1 in which the material thereof is stainless steel.

5. A sleeve as claimed in claim 1 in which the ends of the band are butt welded together.

* * * * *